US007435028B2

(12) United States Patent
Cummings et al.

(10) Patent No.: US 7,435,028 B2
(45) Date of Patent: Oct. 14, 2008

(54) PUSH-UP DISPENSER

(75) Inventors: Bruce Cummings, New York, NY (US); Daniel Ostrowski, New Brunswick, NJ (US)

(73) Assignee: Colgate-Palmolive Company, New York, NY (US)

( * ) Notice: Subject to any disclaimer, the term of this patent is extended or adjusted under 35 U.S.C. 154(b) by 351 days.

(21) Appl. No.: 11/330,455

(22) Filed: Jan. 12, 2006

(65) Prior Publication Data

US 2007/0160412 A1 Jul. 12, 2007

(51) Int. Cl.
*A45D 40/02* (2006.01)

(52) U.S. Cl. ..... 401/182; 401/66; 401/83; 401/176

(58) Field of Classification Search ..... 401/12, 401/65, 66, 83, 86, 87, 117, 176, 179, 182, 401/183; 222/386
See application file for complete search history.

(56) References Cited

U.S. PATENT DOCUMENTS

| | | | | |
|---|---|---|---|---|
| 700,947 | A | 5/1902 | Kendrick | |
| 718,969 | A | 1/1903 | Altshul | |
| 758,234 | A | 4/1904 | Bardin | |
| 1,698,750 | A | 1/1929 | Coryell | |
| 1,850,934 | A | 3/1932 | Janer | |
| 1,851,322 | A | 3/1932 | Pears | |
| 1,969,331 | A | 8/1934 | Small | |
| 2,085,446 | A | 6/1937 | Philippe | |
| 2,171,339 | A | 8/1939 | Julius | |
| 2,371,332 | A | 3/1945 | Jacobson | |
| 2,502,716 | A | 4/1950 | Greene | |
| 2,626,847 | A | 1/1953 | Brown | |
| 2,853,209 | A | 2/1958 | McArdle | |
| 2,887,117 | A | 5/1959 | Rosholt | |
| 3,061,084 | A | 10/1962 | Tibbitts | |
| 3,203,024 | A | 8/1965 | Hawkins et al. | |
| 3,397,027 | A | 8/1968 | Harrison | |
| 3,443,874 | A | 5/1969 | Pelli et al. | |
| 3,768,705 | A | 10/1973 | Sparz | |
| 3,902,814 | A * | 9/1975 | Cardia | 401/83 |
| 4,023,912 | A | 5/1977 | Mahler et al. | |

(Continued)

FOREIGN PATENT DOCUMENTS

| | | |
|---|---|---|
| EP | 0256923 | 2/1988 |

(Continued)

*Primary Examiner*—David J Walczak
(74) *Attorney, Agent, or Firm*—Amy M. Fernandez

(57) ABSTRACT

The dispenser is comprised of a first sleeve that is substantially open at the top and the bottom. A product support is received into the first sleeve, this product support comprising a second sleeve. On the upper part of the second sleeve is a product supporting surface. The lower part of the second sleeve can be contacted by a person's finger to adjust the second sleeve within the first sleeve and to temporarily lock the second sleeve in the first sleeve. On the inner surface of the first sleeve and the outer surface of the second sleeve there are cooperating structures to maintain the second sleeve at a given position in the first sleeve upon the gripping of the first sleeve. In use the second sleeve is adjusted within the first sleeve by pushing up on the bottom of the second sleeve. The sides of the first sleeve are gripped in an appplication grip which holds the second sleeve within the first sleeve during application of the product.

20 Claims, 6 Drawing Sheets

U.S. PATENT DOCUMENTS 4,169,547 A 10/1979 Newell
4,621,935 A 11/1986 Sussman
4,645,098 A 2/1987 Hoffmann
4,700,448 A 10/1987 Parker
4,708,507 A 11/1987 von Schuckmann
5,286,126 A 2/1994 Harris et al.
5,421,663 A * 6/1995 Bravo ..... 401/82
5,833,382 A 11/1998 Jenks et al.
5,897,263 A 4/1999 Fattori
5,944,434 A 8/1999 Schlatter
5,984,553 A * 11/1999 Piscopo et al. ..... 401/82
5,997,202 A 12/1999 Durocher
6,821,041 B1 11/2004 Hallam et al.

FOREIGN PATENT DOCUMENTS

FR 002578727 A1 9/1986

* cited by examiner

PUSH-UP DISPENSER

FIELD OF THE INVENTION

This invention relates to a push-up dispenser for solid and viscous products. More particularly this invention relates to a dispenser which can be maintained at the dispensing position by a gripping of the dispenser walls.

BACKGROUND OF THE INVENTION

Dispensing containers are used with regard to a number of cosmetic products. These include solid products such as lipsticks, deodorants and antiperspirants and various viscous lotion and gel products such as body lotions and gels, sunscreens, and deodorant and antiperspirant lotions and gels. Lipsticks are usually in a cylindrical form with a circular cross-section and are in a tubular container with a closure. The lipsticks are either manually elevated in the container for use or utilize a push-up mechanism on the container. Deodorants and antiperspirants usually use a mechanism to elevate the solid, lotion or gel product for use. This mechanism typically is located in the base of the dispenser and consists of a platform elevator that supports the deodorant or antiperspirant, an attached screw, and a disc wheel grip on the other end of the attached screw to rotate the screw and thereby to raise and lower the platform elevator. Deodorants and antiperspirants also use mechanisms that are located in the wall of the container part of the dispenser.

These prior art dispensers are all useful and effective dispensers. However they consist of six or more parts that must be produced and assembled. The problem is to how best reduce the number of parts and the cost of the dispensers. One solution is to use a push-up dispenser. However the problem then is how to maintain the product at a selected level in the dispenser while the product is being applied to a surface. One technique is to have a finger hold the product support at a given level during the application of the product. This is exemplified in U.S. Pat. No. 3,397,027; U.S. Pat. No. 4,621,935 and U.S. Pat. No. 5,944,434. In each of these patents a person pushes the supported product upward for dispensing and then maintains the finger in contact with the product support during dispensing. This maintains the product at the application level and so that it does not recede into the container. In another technique the product support is mechanically maintained at a given level by a friction contact of the product support with the wall of the dispenser. This is exemplified by U.S. Pat. No. 1,850,934; U.S. Pat. No. 5,286,126; U.S. Pat. No. 5,897,263; U.S. Pat. No. 4,621,935 and U.S. Pat. No. 4,708,507. These are effective as long as a medium to high application force is not used. When such a force is used the product will recede back into the container portion of the dispenser.

The present invention solves this problem through the use of a dispenser with only three primary parts and with the dispenser having a positive locking mechanism for the product support during product application. This prevents the product support and the product slipping down into the container during use.

BRIEF DESCRIPTION OF THE INVENTION

The present dispenser is adapted to minimize the parts that are needed while providing a dispenser that is easy to use. This also reduces the number of parts that need to be assembled. The dispenser comprises a first sleeve which is substantially open at the top and the bottom. A product support that includes a second sleeve which is received in the first sleeve. The second sleeve has a lower surface that is adapted to be contacted by a person's finger to adjust the second sleeve in the first sleeve. The inner surface of the first sleeve and the outer surface of the second sleeve have interfering structures such that when they are in contact the second sleeve is maintained in a set orientation, one to the other. This contact is the result of the first sleeve being pushed into contact with the second sleeve by the holding and gripping of the first sleeve. This contact can be enhanced through one or more apertures in the first sleeve walls to increase the flexibility of the first sleeve and consequently it's flexing against the second sleeve.

The interfering structure can be of any kind where the second sleeve can be maintained at a plurality of positions relative to the first sleeve. This can be accomplished by mating serrations on the inner surface of the first sleeve and on the outer surface of the second sleeve; serrations on the inner surface of the first sleeve and a mating projection on the outer surface of the second sleeve; and serrations on the outer surface of the second sleeve and a mating projection on the inner surface of the first sleeve. Other structures that produce the same result would be considered to be equivalent structures.

In use a closure is removed from the dispenser and the second sleeve pushed upward to a position to dispense the product. Then by a normal gripping of the first sleeve to hold it for use, the first sleeve flexes and the first and second sleeves become locked together temporarily whereby the second sleeve cannot recede within the first sleeve during use. After use by relaxing the gripping the first sleeve and the second sleeve become unlocked, the closure is placed onto the dispenser, and the second sleeve receded into the first sleeve. If the product is too high the closure as it is being put into place will contact the product and move it downward into the first sleeve along with the second sleeve on which it is supported.

The primary parts of the dispenser are the first sleeve, the second sleeve and the closure. Conventional dispensers can have five or more primary parts.

DETAILED DESCRIPTION OF THE INVENTION

Figure 1:
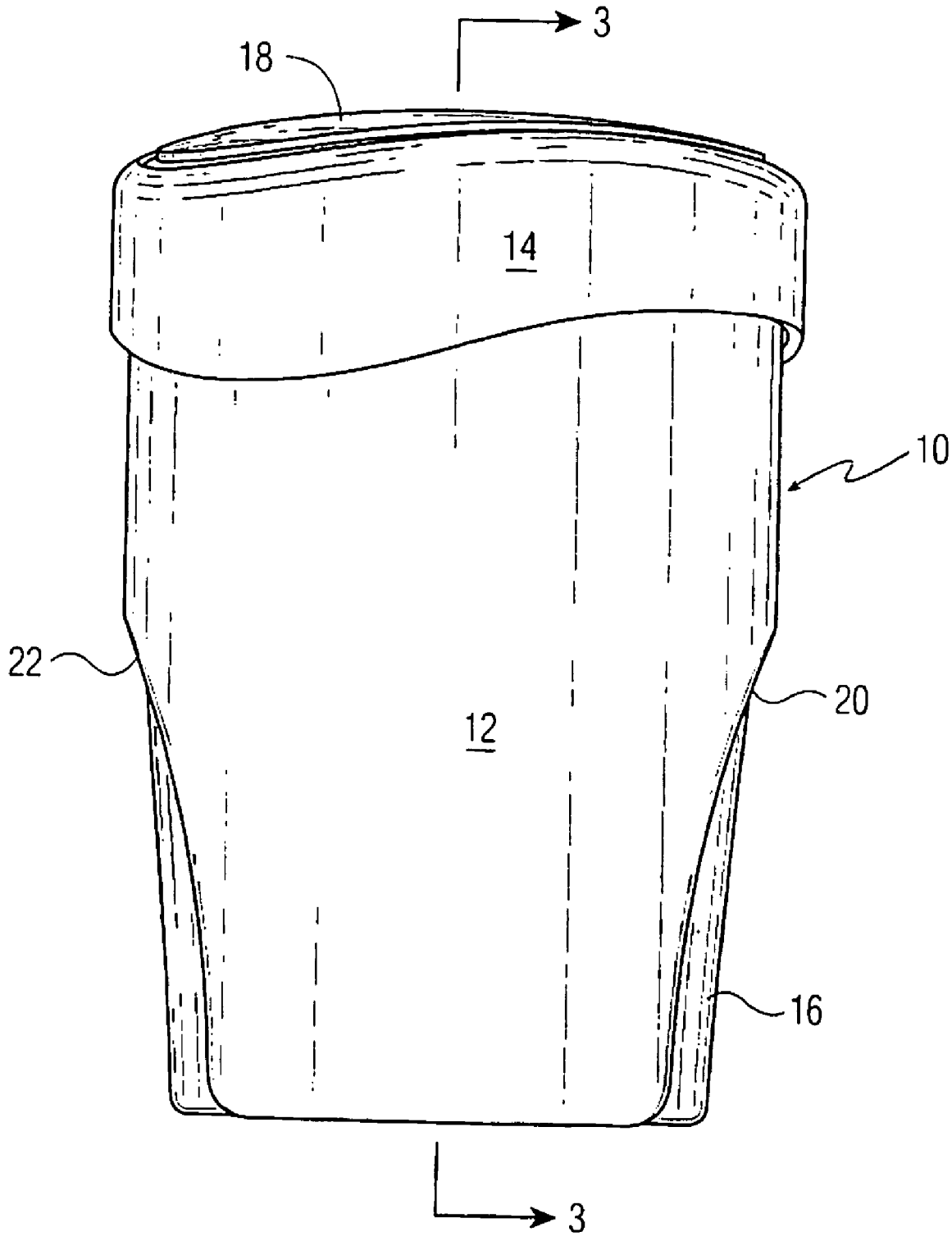
FIG. 1 is a front elevation view of the present dispenser.

The invention will be described in more detail in its preferred embodiments with reference to Figures in the drawings. Modifications can be made to the disclosed embodiments but all such modifications are with the concept of the present invention.

FIG. 1 is a front elevation view of the present dispenser 10. This dispenser 10 can be used to dispense solid and semi-solid products and is very useful for dispensing cosmetic products. These products include lipsticks, rouges, lip medications, deodorants and antiperspirants. The dispenser 10 is comprised of first sleeve 12, second sleeve 16 and closure 14. The closure has a top surface 18. The first sleeve has apertures 20 and 22 on the opposite side surfaces. The apertures extend from the lower surface of the first sleeve upwardly to increase the flexibility of the front and rear surfaces of the first sleeve. The apertures can be of essentially any shape depending on the increased flexibility that is desired. However an inverted U-shape is a preferred shape for the apertures since in addition to an increase in flexibility it enhances the pushing up of the second sleeve in the first sleeve to a raised dispensing position.

Figure 2A:
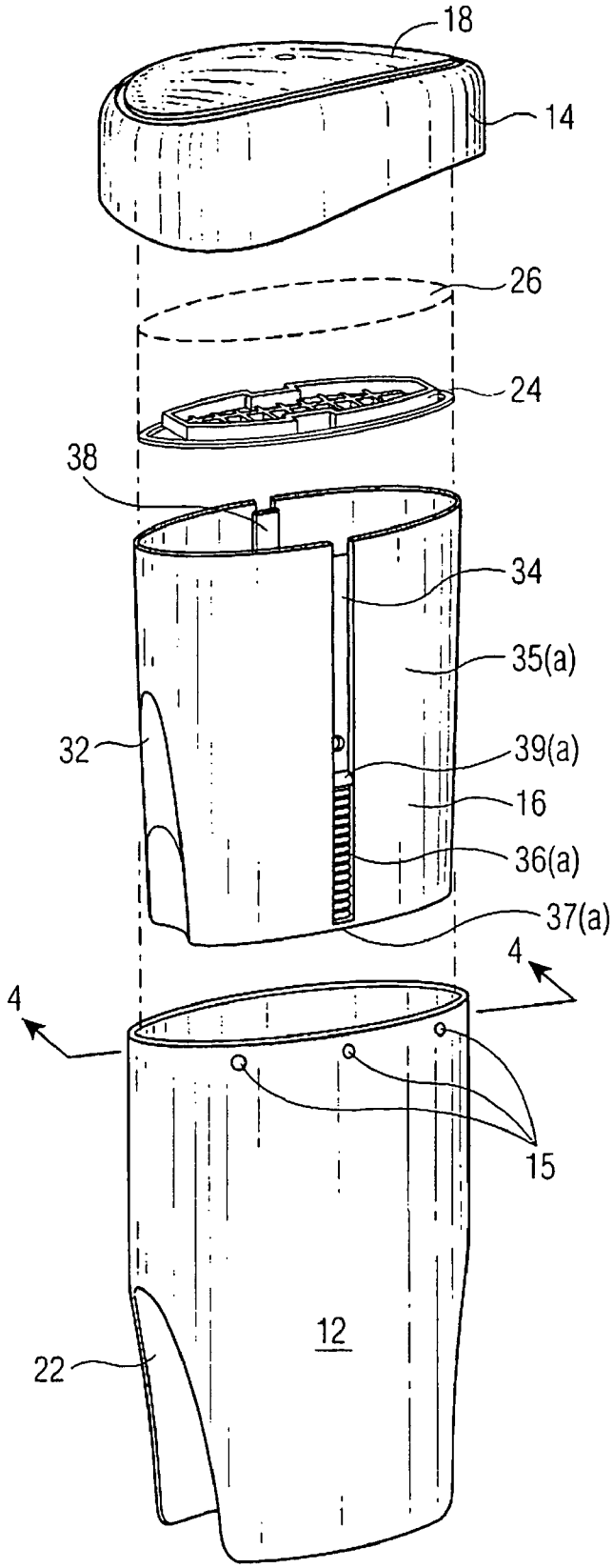
FIG. 2A is an exploded view of the front side dispenser of FIG. 1.
Figure 2B:
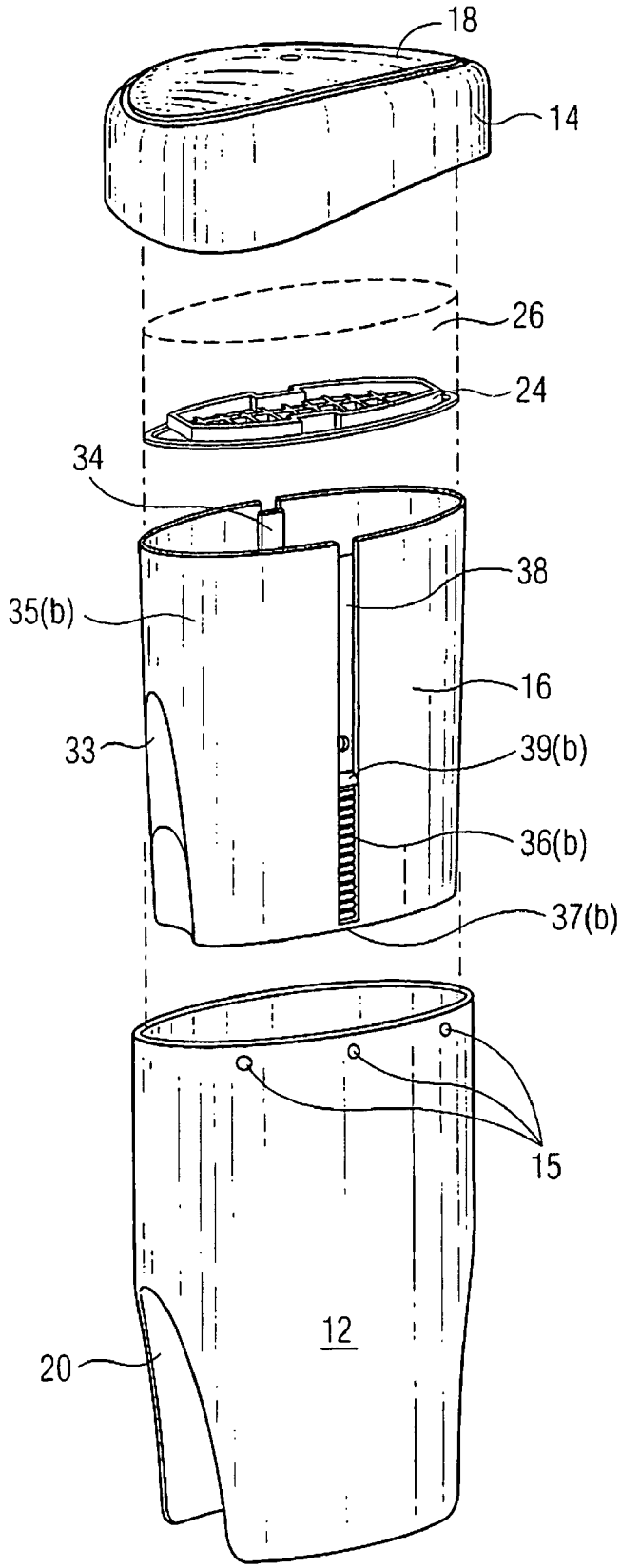
FIG. 2B is an exploded view of the rear side of the dispenser of FIG. 1.

FIG. 2A is an exploded view of the front side of the dispenser 10 of FIG. 1 with FIG. 2B being an exploded view of the rear side of the dispenser 10. In FIG. 2A first sleeve 12 is shown with aperture 22. This is shown in an inverted u-shape. The projections 15 aid in securing the closure 14 onto the first sleeve 12. The second sleeve 16 has a surface 35(*a*) with a slot 34 on a front surface. There is a similar slot 38 on the rear surface 35(*b*) as can be seen in FIG. 2B. Within a lower part of slot 34 of FIG. 2A there are a plurality of serrations 36(*a*). Similarly in the lower part of slot 38 of FIG. 2B there a plurality of serrations 36(*b*). There is a slot on both the front and rear surfaces to facilitate assembly and use. However the dispenser can be effectively used with a slot on only one of the surfaces. With the front and rear surfaces being the same the second sleeve 16 can be inserted into the first sleeve 12 in any orientation. This simplifies the assembly of the parts. The slot 34 has an upper ledge 39(*a*) and a lower ledge 37(*a*). The slot 38 has upper ledge 39(*b*) and lower ledge 37(*b*). These ledges limit the travel of the second sleeve 16 in the first sleeve 12.

The recess 32 of the second sleeve 16 coordinates with the aperture 22 of the first sleeve to increase the ease of the moving the second sleeve 16 upward in the first sleeve 12. In the preferred embodiment there is a companion recess 33 on the opposite side surface as shown in FIG. 2B. The product holder 24 is fitted into the top of the second sleeve 16 being supported by the upper edge of slots 34 and 38. There can be additional projections on the inner surface of the second sleeve 16 to assist in supporting the product holder 24. The product 26 is shown in dashed lines. The closure 14 will cover the product 26 when the dispenser is not in use.

Figure 3A:
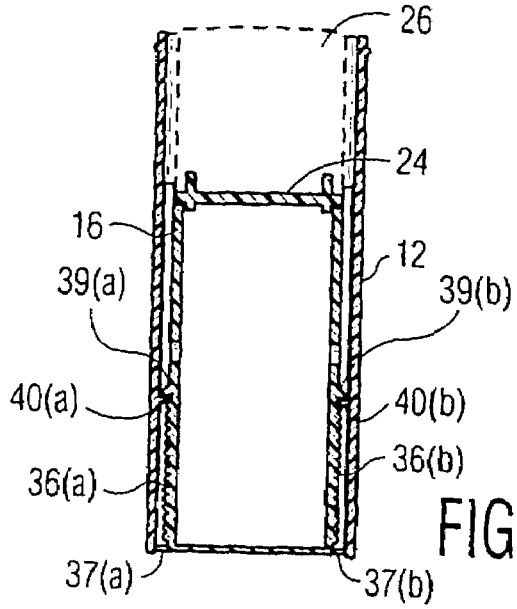
FIG. 3A is a vertical cross-section view of the dispenser of FIG. 1 along line 3-3 of FIG. 1 with the product within the dispenser.

FIG. 3A is a vertical cross-section of the dispenser 10 of FIG. 1 with the closure 14 removed and in preparation for use. The product 26 is supported on product holder 24. On the lower part of second sleeve 16 there are serrations 36(*a*) and 36(*b*). These serrations are in slots 34 (see FIG. 2A) and 38 (see FIG. 2B) respectively. Shown here are lower ledges 37(*a*) and 37(*b*) and upper ledges 39(*a*) and 39(*b*) for the limiting of the movement of the second sleeve 16 in the first sleeve 12. Projections 40(*a*) and 40(*b*) on the inner surface of first sleeve 12 contact the serrations 36(*a*) and 36(*b*) to lock the second sleeve 16 in the first sleeve 12 by the flexing contact of the first sleeve 12 with the second sleeve 16. Projections 40(*a*) and 40(*b*) also will limit the travel of the second sleeve 16 in the first sleeve 12 by contact with the upper ledges 39(*a*) and 39(*b*) of the second sleeve 16. Here in FIG. 3A the projections 40(*a*) and 40(*b*) are shown as being adjacent to the upper ledges 39(*a*) and 39(*b*) thereby limiting the downward travel of the second sleeve 16 in first sleeve 12.

Figure 3B:
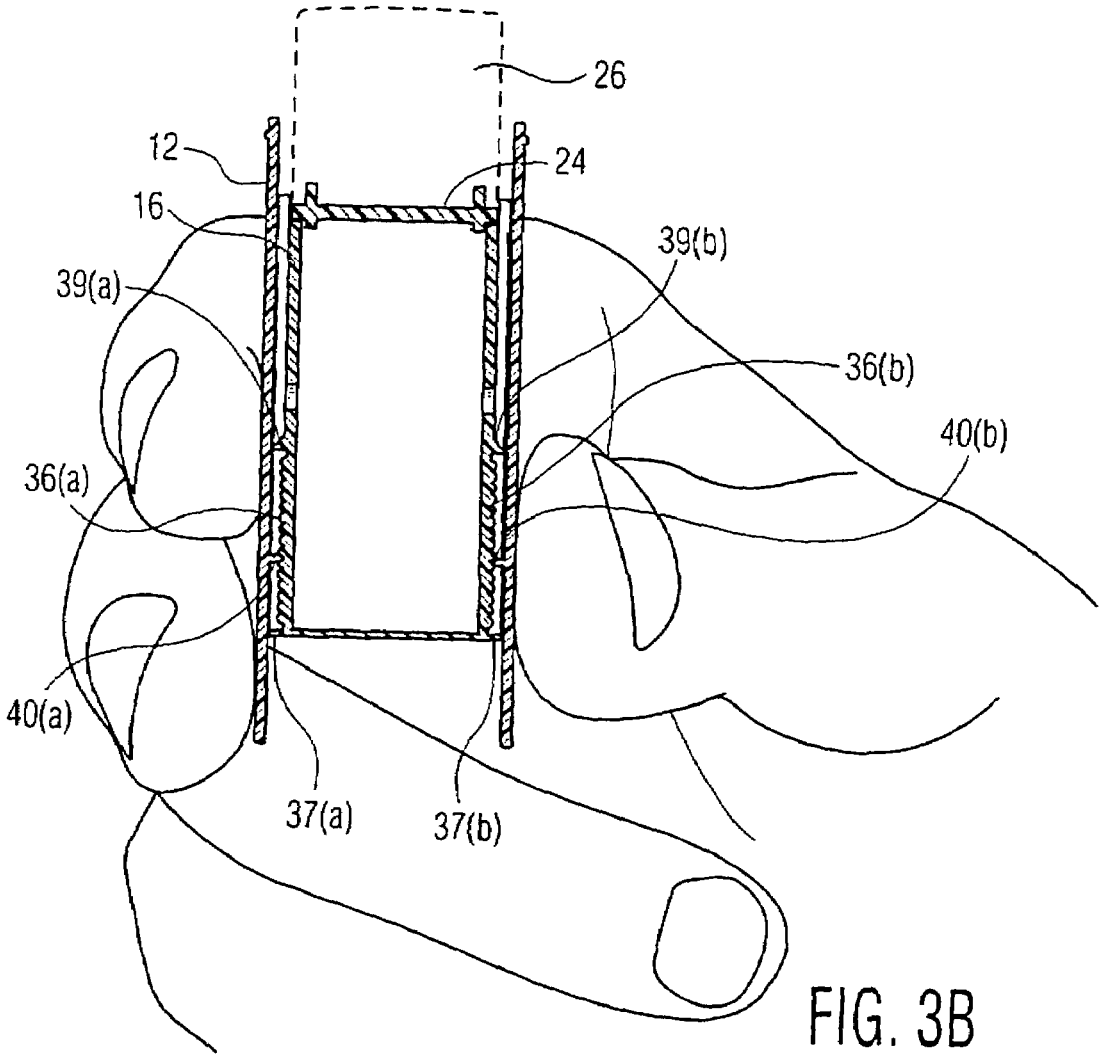
FIG. 3B is a vertical cross-section view of the dispenser of FIG. 1 along line 3-3 of FIG. 1 with the product being dispensed from the dispenser.

FIG. 3B is a vertical cross-section which shows the dispenser 10 in a mode to be used. The product 26 is raised up above the first sleeve 12 by the pushing up on the second sleeve 16. By pressing inward on the exterior sides of the first sleeve 12 the projections 40(*a*) and 40(*b*) interact with the serrations 36(*a*) and 36(*b*) to hold the product 26 at the shown position.

Figure 4:
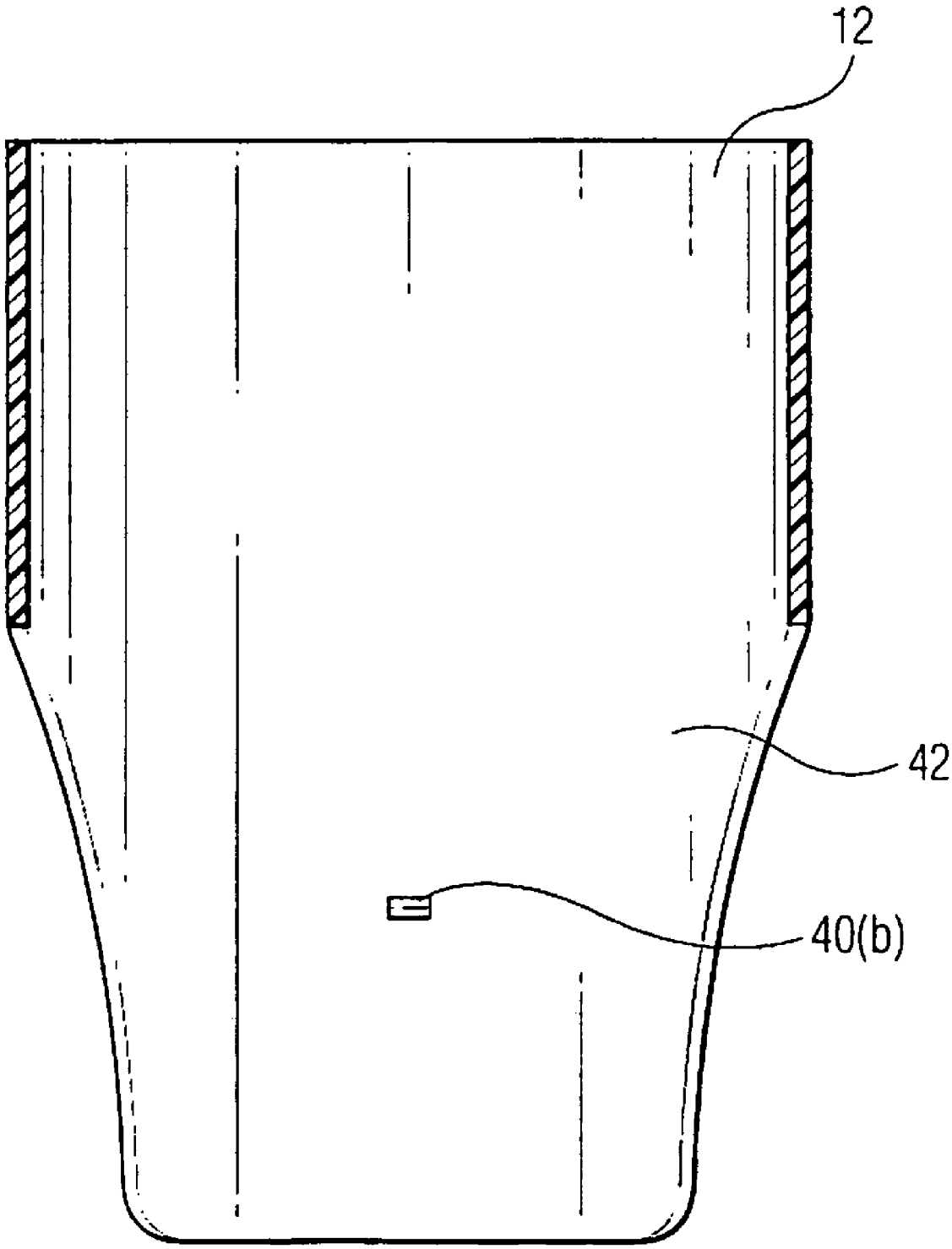
FIG. 4 is a cross-sectional view of the first sleeve along line 4-4 of FIG. 2A.

FIG. 4 is a cross-section of the first sleeve 12 along line 4-4 of FIG. 2A. It shows the interior surface 42 and projection 40(*a*). This projection interacts with the serrations 36(*a*) of the second sleeve 16 to maintain the second sleeve at a set position in sleeve 12.

Figure 5:
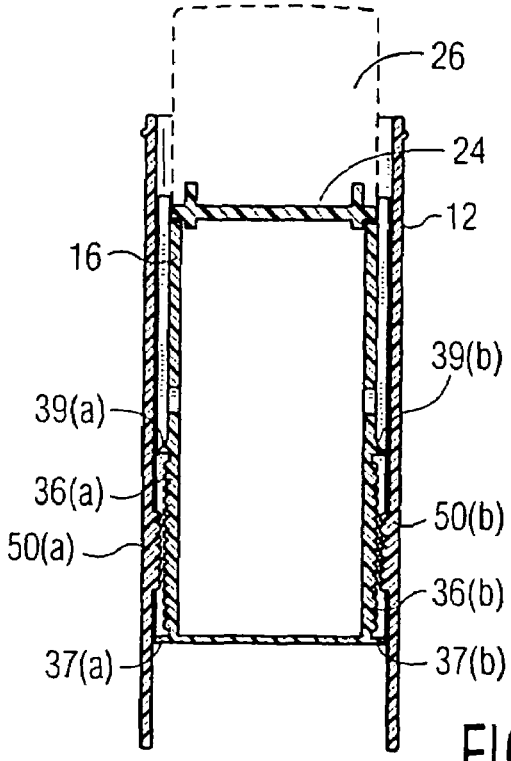
FIG. 5 is a further embodiment which shows serrations on both the first sleeve and the second sleeve of the dispenser.

FIG. 5 is a cross-section of an alternate embodiment for the maintaining of the second sleeve 16 in a dispensing position in the first sleeve 12. The dispenser parts that are the same as those of FIGS. 3A and 3B retain the parts numbers of those figures. The difference here is that in place of projections 40(*a*) and 40(*b*) on first sleeve 12 of FIGS. 3A and 3B there are sets of serrations 50(*a*) and 50(*b*). In order to maintain the second sleeve 16 at a given level in first sleeve 12 the serrations 36(*a*) and 36(*b*) of the second sleeve 16 and interfitted into the serrations 50(*a*) and 50(*b*) of the first sleeve 12. This is the result of the flexing of first sleeve 12 against second sleeve 16.

Figure 6:
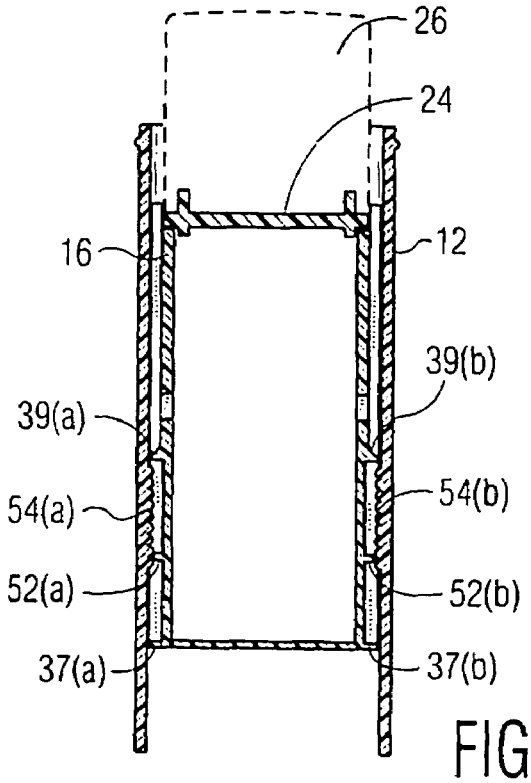
FIG. 6 is a further embodiment which shows serrations on the first sleeve and a projection on the second sleeve.

FIG. 6 is a cross-section of a further alternate embodiment for the maintaining of the second sleeve in a dispensing position in the first sleeve 12. The dispenser parts that are the same as those of FIGS. 3A and 3B retain the parts numbers of those figures. The difference here is that in place of projections 40(*a*) and 40(*b*) on the inner surface of first sleeve 12 of FIGS. 3A and 3B there are sets of serrations 54(*a*) and 54(*b*). And in place of the serrations 36(*a*) and 36(*b*) on the outer surface of the second sleeve 16 there are projections 52(*a*) and 52(*b*). This is the reverse of the arrangement of the serrations and projections of FIGS. 3A and 3B.

The parts for the dispenser 10 can be made by conventional injection molding processes using conventional thermoplastics. Useful thermoplastics are the polymers and copolymers of ethylene, propylene, butene and butadiene and various polyesters such as polyethylene terephthalate.

The dispenser 10 can be produced by a top filling technique where the second sleeve 16 is lowered in first sleeve 12 to a level that will hold a set volume of product. This also will be related to a particular gram weight. The first sleeve 12 is filled to about the upper edge of the first sleeve 12 with the liquid heated product. The inner volume of the second sleeve also will contain some of the product. The closure 14 then is placed onto the first sleeve 12 and the filled dispenser inverted and cooled to solidify the heated liquid product. The upper surface of the solidified product will have a shape that is complementary to the inner surface of the closure 14.

To use the dispenser 10 a person removes the closure 14, pushes up on the bottom surface of second sleeve 16 to raise the product above the upper edge of the first sleeve 12. The outer surface of the first sleeve 12 is gripped at an applicating grip strength which will cause the cooperating interference structure on the inner surface of the first sleeve 12 to contact the interference structure on the outer surface of the second sleeve 16. This will temporarily lock the sleeves to a set orientation, one to the other. The product then is applied and after application the gripping is released to a lighter holding grip whereby the first sleeve 12 and the second sleeve 16 unlock. The second sleeve 16 can be retracted into the first sleeve 12 with the product being stored within the first sleeve 12. The closure 14 is then put onto first sleeve 12. The closure being put into place can assist in the receding of the second sleeve and product into the first sleeve 12.

We claim:

1. A dispenser for a product comprising a first sleeve having an inner surface and an outer surface substantially open at a bottom end and at a top end, a product support received within the first sleeve, the product support comprising a second sleeve the having an inner surface and an outer surface and an upper surface for supporting the product, the second sleeve having a lower surface adapted for contact with a finger of a person to adjust the position of the second sleeve within the first sleeve, the inner surface of the first sleeve having an interfering structure with a coordinating interfering structure on the outer surface of the second sleeve, the first sleeve having a flexing structure where upon the application of a force moves the coordinating interfering structure of the first sleeve into contact with the coordinating interfering structure of the second sleeve, the first and second sleeves being maintained at a set relative position, one to the other, when the first sleeve is flexed against the second sleeve thereby holding the coordinating interfering structure of the inner surface of the first sleeve against the coordinating interfering structure of the outer surface of the second sleeve and the product in a set position for dispensing.

2. A dispenser as in claim 1 wherein the first sleeve and the second sleeve are oval having opposed front and rear surfaces and opposed side surfaces.

3. A dispenser as in claim 2 wherein the first sleeve has at least one aperture in a surface thereof to increase the flexing of the first sleeve against the second sleeve.

4. A dispenser as in claim 3 wherein the shape of the at least one aperture is of an inverted U-shape which allows the first sleeve to flex to contact the second sleeve to thereby adjust the second sleeve within the first sleeve and hold the product at a set position.

5. A dispenser as in claim 3 wherein the first sleeve has at least two apertures, the at least two apertures being on said opposed side surfaces.

6. A dispenser as in claim 5 wherein the structure of the at least two apertures allows the coordinating interfering structure of the first sleeve to flex to contact the coordinating interfering structure of the second sleeve to thereby adjust the second sleeve within the first sleeve.

7. A dispenser as in claim 6 wherein each of the at least two apertures is generally U-shaped.

8. A dispenser as in claim 1 wherein the coordinating interfering structure at least one serration structure on at least on one of the first sleeve or the second sleeve.

9. A dispenser as in claim 8 wherein the first sleeve and the second sleeve are oval in shape having a front surface, a rear surface and two side surfaces.

10. A dispenser as in claim 8 wherein the coordinating interfering structure comprise a projection on the first sleeve and a serration structure on the second sleeve.

11. A dispenser as in claim 1 wherein the coordinating interfering structures comprise a projection on the first sleeve and a serration structure on the second sleeve.

12. A dispenser as in claim 1 wherein the coordinating interfering structures comprises a projection on the second sleeve and a serration structure on the first sleeve.

13. A dispenser for a product comprising a first sleeve having an inner surface and an outer surface and substantially open at a bottom and at a top, a product support received within the first sleeve, the product support comprising a second sleeve having an inner surface and an outer surface and an upper surface for supporting the product, the second sleeve having a lower surface adapted for contact with a finger of a person to adjust the second sleeve in the first sleeve, the first sleeve and the second sleeve being oval in shape and having opposed front and rear surfaces and opposed side surfaces, the inner surface of the first sleeve having an interfering structure with an interfering structure on the outer surface of the second sleeve, the first sleeve having a structure to flex upon the application of a force to cause the coordinating interfering structure of the first sleeve to move into contact with the coordinating interfering structure of the second sleeve, the first and second sleeves being maintained at a set relative position one to the other when the first sleeve is flexed into contact with the second sleeve to thereby maintain the product in a set position for dispensing.

14. A dispenser as in claim 13 wherein the first sleeve has at least one aperture in a surface thereof to increase flexing, the at least one aperture being of an invented U-shape.

15. A dispenser as in claim 14 wherein there are at least two apertures in the first sleeve, the structure of the apertures allows the first sleeve to flex to contact the second sleeve whereby the coordinating interfering structure of the first sleeve contacts the coordinating interfering structure of the second sleeve.

16. A dispenser as in claim 13 wherein the coordinating interfering structures comprises at least one serration structure on at least one of the first sleeve or the second sleeve.

17. A dispenser as in claim 16 wherein the coordinating interfering structures comprise a serration structure on the first sleeve and on the second sleeve.

18. A dispenser as in claim 13 wherein the coordinating interfering structures comprise a projection on the first sleeve and a serration structure on the second sleeve.

19. A dispenser as in claim 13 wherein the coordinating interfering structures comprise a projection on the second sleeve and a serration structure on the first sleeve.

20. A dispenser as in claim 1 wherein the dispenser contains the product, the product being selected from the group consisting of deodorants, antiperspirants, lipsticks and medicants.

* * * * *